US009267340B2

(12) United States Patent
Ankargren et al.

(10) Patent No.: US 9,267,340 B2
(45) Date of Patent: Feb. 23, 2016

(54) HEAVE COMPENSATING SYSTEM

(75) Inventors: David Bengt Johan Ankargren, Kristiansand (NO); Jochen Pohl, Partille (SE)

(73) Assignee: National Oilwell Varco Norway AS, Kristiansand (NO)

( * ) Notice: Subject to any disclaimer, the term of this patent is extended or adjusted under 35 U.S.C. 154(b) by 226 days.

(21) Appl. No.: 13/988,281

(22) PCT Filed: Oct. 11, 2011

(86) PCT No.: PCT/GB2011/001467

§ 371 (c)(1),
(2), (4) Date: Aug. 9, 2013

(87) PCT Pub. No.: WO2012/066268

PCT Pub. Date: May 24, 2012

(65) Prior Publication Data

US 2013/0312979 A1 Nov. 28, 2013

(30) Foreign Application Priority Data

Nov. 18, 2010 (GB) ..... 1019555.0

(51) Int. Cl.

| | |
|---|---|
| ***E21B 19/09*** | (2006.01) |
| ***E21B 19/00*** | (2006.01) |
| ***B66C 13/02*** | (2006.01) |
| ***B66D 1/52*** | (2006.01) |

(52) U.S. Cl.
CPC ..... *E21B 19/006* (2013.01); *B66C 13/02* (2013.01); *B66D 1/525* (2013.01)

(58) Field of Classification Search
CPC ... E21B 19/002; E21B 19/004; E21B 19/006; E21B 19/09
USPC ..... 166/355, 352; 405/196
See application file for complete search history.

(56) References Cited

U.S. PATENT DOCUMENTS

| | | | | |
|---|---|---|---|---|
| 3,653,636 | A | 4/1972 | Burrell | |
| 3,905,580 | A | 9/1975 | Hooper | |
| 4,176,722 | A * | 12/1979 | Wetmore et al. | 175/7 |

(Continued)

FOREIGN PATENT DOCUMENTS

| | | |
|---|---|---|
| EP | 2113672 A1 | 11/2009 |
| GB | 2055342 A | 7/1979 |

(Continued)

OTHER PUBLICATIONS

International Application No. PCT/GB2011/001467 Search Report and Written Opinion dated Mar. 19, 2013.

*Primary Examiner* — Matthew R Buck
*Assistant Examiner* — Patrick Lambe
(74) *Attorney, Agent, or Firm* — Conley Rose, P.C.

(57) ABSTRACT

A heave compensating system for a marine vessel includes a hydraulic machine configured to be coupled to a load suspended from the vessel and to vary the distance between the load and the vessel in response to heaving motion of the vessel. The system further includes a second hydraulic machine in fluid communication with a hydraulic accumulator, both the first and second hydraulic machines are mechanically connected to one another and a shared electric motor, and a controller configured to control hydraulic movement of the first and second hydraulic machines and to control the supply of power to the electric motor.

17 Claims, 4 Drawing Sheets

(56) References Cited

U.S. PATENT DOCUMENTS

| | | | |
|---|---|---|---|
| 5,209,302 | A | 5/1993 | Roabichaux et al. |
| 2001/0035011 | A1 | 11/2001 | Endo et al. |

FOREIGN PATENT DOCUMENTS

| | | | |
|---|---|---|---|
| GB | 2188899 | A | 10/1987 |
| WO | 2005113929 | A1 | 12/2005 |

* cited by examiner

HEAVE COMPENSATING SYSTEM

CROSS-REFERENCE TO RELATED APPLICATIONS

This application is a 35 U.S.C. §371 national stage application of PCT/GB2011/001467 filed Oct. 11, 2011, which claims the benefit of British Patent Application No. 1019555.0 filed Nov. 18, 2010, both of which are incorporated herein by reference in their entireties for all purposes.

STATEMENT REGARDING FEDERALLY SPONSORED RESEARCH OR DEVELOPMENT

Not applicable.

BACKGROUND

1. Field of Technology

The present disclosure relates to a heave compensating system, and more particularly relates to a heave compensating system for a marine vessel.

2. Background Information

As is well known, the search for hydrocarbons through the seabed often involves the use of floating marine vessels such as drill-ships or floating marine platforms. The use of floating vessels of this type is generally considered advantageous over the alternative of using fixed platforms resting on the seabed during exploratory operations as they are more readily moveable from site to site.

However, vessels are subjected to upward and downward heave motions due to wave action. A coring or drilling tool is typically carried at the lower end of a string or drill pipe suspended from the vessel. During coring operations, if no compensation is made for the heaving motion of the vessel above, very substantial variations can result in the force applied to the coring tool in the seabed, and this can result in unpredictable compactions or weakenings in the core retrieved the tool, thereby destroying the core or at least reducing its effectiveness for analysis. During drilling operations, heave-induced load variations on a drill bit are known to accelerate the wear of the bit. As will be appreciated, if a vessel is caused to move in heave to an excessive degree, for example in rough sea, very significant damage can be caused to such tools. It can also be important to compensate for the heave motion of a floating vessel when performing other types of hoisting operation from the vessel.

Heave compensating systems have therefore been proposed and are generally used on such vessels to maintain a substantially constant force on the tools, and optionally to maintain the tools in a substantially constant position, as the vessel rises and falls in heave. Previously proposed heave compensator systems generally comprise a motion-compensating hydraulic cylinder associated with the crown block or the travelling block of a derrick arrangement mounted on the vessel and from which the drill string or other tool or load is suspended. The hydraulic cylinder is fluidly connected to a hydraulic accumulator that is driven by the flow of the hydraulic fluid between the cylinder and the accumulator. Such a system is purely passive in nature.

In a purely passive arrangement of the type described above, the nominal pressure charge of the accumulator determines the nominal hydraulic pressure of the compensating cylinder, which in turn determines the magnitude of the load suspended from the vessel which can be held substantially constant despite heaving motion of the vessel. The accumulator's pre-charge pressure must therefore be adjusted to balance the static load whose motion is to be compensated. However, prior art systems of this general type are known to exhibit substantial force variations due to the pressure-dependency of the accumulator on its charge. These variations may sometimes be tolerated for systems such as a so-called deadline compensator, but may require further compensation in other systems, such so-called crown mounted compensators. In such systems, this further compensation is generally achieved via the use of mechanical, position-dependent transmissions. Nevertheless, while such arrangements can reduce the accumulator charge-dependent force variations, they cannot readily compensate for friction damping and inertia effects. It is therefore common practice to add an active heave compensator arrangement to compensate for these force variations in the passive arrangement. However, conventional combined passive/active heave compensator arrangements can be very complicated, expensive, bulky and can be limited in various operational modes.

BRIEF SUMMARY OF THE DISCLOSURE

According to the present disclosure, there is provided a heave compensating system for a marine vessel that includes a hydraulic actuator of the vessel configured to couple to a load suspended from the vessel and vary the distance between the load and the vessel in response to heaving motion of the vessel, In this system, the hydraulic actuator is connected to a first hydraulic machine for actuation by the first hydraulic machine. The system further includes a second hydraulic machine connected to a hydraulic accumulator, wherein both the first and second hydraulic machines are coupled to one another and to a shared electric motor. A controller of the system is configured to control hydraulic movement of the first and second hydraulic machines and to control the supply of power to the electric motor in response to one or more signals representative of at least one of a wave-induced heave movement of the vessel and a wave induced force applied to the load.

In an embodiment, the system is configured to maintain a substantially constant support force on a load suspended from the vessel despite heaving movement of the vessel. In this embodiment, the two hydraulic machines and the electric motor are coupled via a direct 1:1 ratio. However, the hydraulic machines and the motor can be coupled via different ratios. The two hydraulic machines and the electric motor are all mounted about a common drive shaft and the motor is mounted between the two hydraulic machines. Alternatively, both of the hydraulic machines are located to the same side of the motor. Each hydraulic machine has a respective drive shaft, the two shafts being substantially co-axial and coupled via the motor, the motor being arranged between said drive shafts for rotation about the axis of said shafts. In an embodiment, the electric motor is an asynchronous motor. Alternatively, the electric motor is a variable speed motor.

In an embodiment, the system further comprises a valve coupled to the accumulator and the actuator, wherein the valve is configured to move between a first position in which the accumulator and the actuator are fluidly isolated from one another, and a second position in which the accumulator and the actuator are connected. In this embodiment, the controller is configured to control operation of the valve in response to a signal representative of the hydraulic pressure in the accumulator, and configured to move the valve from the first position to the second position in response to the pressure falling to a predetermined threshold value. The controller is configured to receive a signal representative of the hydraulic pressure in the accumulator, and to control power to the electric motor in response thereto. The controller is also configured to receive a signal representative of the position of the load relative to the vessel and to control movement of the first and second hydraulic machines in response thereto.

In an embodiment, the system is configured to maintain a substantially constant support force on the load suspended from the vessel during heaving movement of the vessel. The system is also configured to maintain the load suspended from the vessel in a substantially constant position during heaving movement of the vessel.

According to another aspect of the present disclosure, there is provided a method of operating a heave compensating system of the type defined above in an active mode in which the controller actively controls energization of the electric motor. In an embodiment, the power supplied to the electric motor is controlled in response to the hydraulic pressure in the accumulator in said first mode. According to another aspect of the present disclosure, there is provided a method of operating a heave compensating system of the type defined above in a passive mode in which the motor is not energized. According to a further aspect of the present disclosure, there is provided a method of operating a heave compensating system of the type defined above, wherein the valve is moved from its first position to its second position to connect the actuator and the accumulator, thereby bypassing the first and second hydraulic machines, in response to the pressure within the accumulator falling below a predetermined threshold value.

BRIEF DESCRIPTION OF THE DRAWINGS

So that the disclosure may be more readily understood, and so that further features thereof may be appreciated, an embodiment of the disclosure will now be described by way of example with reference to the accompanying drawings in which.

DETAILED DESCRIPTION

Figure 1:
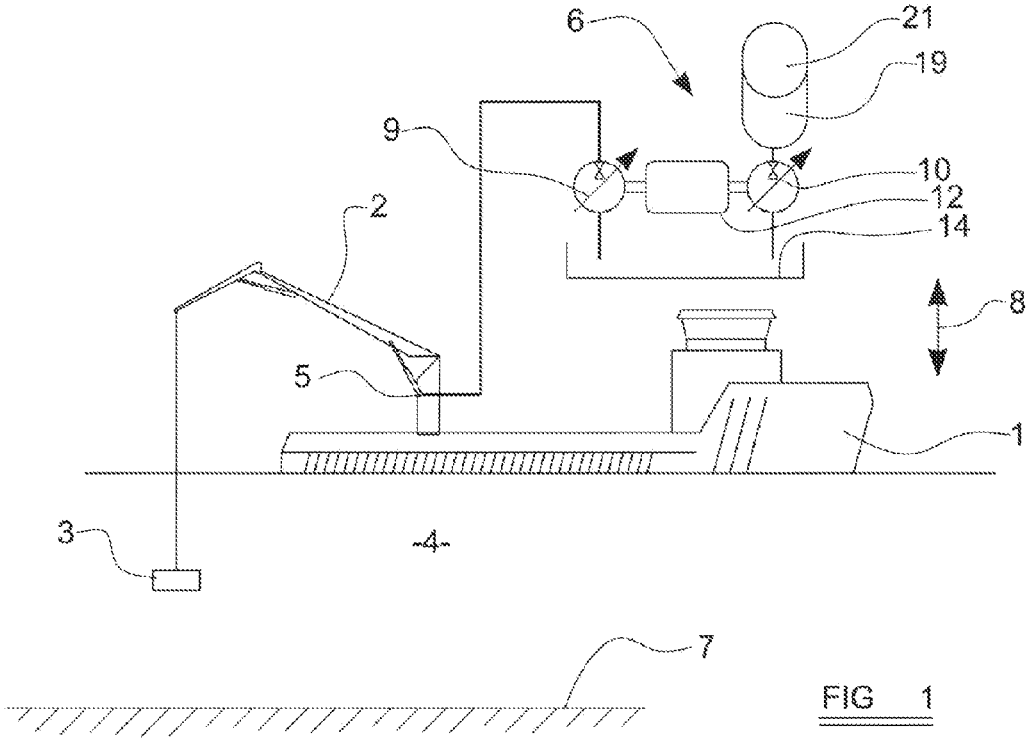
FIG. 1 is schematic illustration showing a floating vessel with a lifting arrangement from which a load is suspended and which is operable by a heave compensating system in accordance with the present disclosure.

Referring initially to FIG. 1, there is illustrated a floating vessel 1 having a crane 2. The crane 2 is shown suspending a load 3 from the vessel into the sea 4. The load 3 is lifted and lowered via operation of a hydraulic actuator 5. The vessel 1 is equipped with a hydraulic heave compensating system, indicated generally at 6, which will be described in detail below and which is configured to maintain a substantially constant support force on the load 3 and to maintain the load in a substantially constant position relative to the seabed 7 despite heaving movement 8 of the vessel in the seaway. The heave compensating system operates to control the actuator 5, and so the actuator 5 can be considered to represent a compensating actuator when operating in this mode.

Although the vessel 1 is shown in FIG. 1 in a configuration for lifting and lowering a load 3 via a crane 2, it is to be appreciated that the heave compensating system 6 of the present disclosure is also suitable for use in maintaining drilling or coring tools, or indeed any other equipment suspended from the vessel 1 in a substantially constant position relative to the seabed 7 and under substantially constant load as the vessel moves in heave.

The heave compensating system 6 comprises a first hydraulic machine 9 and a second hydraulic machine 10, both of which are designed to operate as rotary pumps/motors. In some arrangements the two hydraulic machines 9, 10 are both provided in the form of over-center rotary machines.

Figure 2:
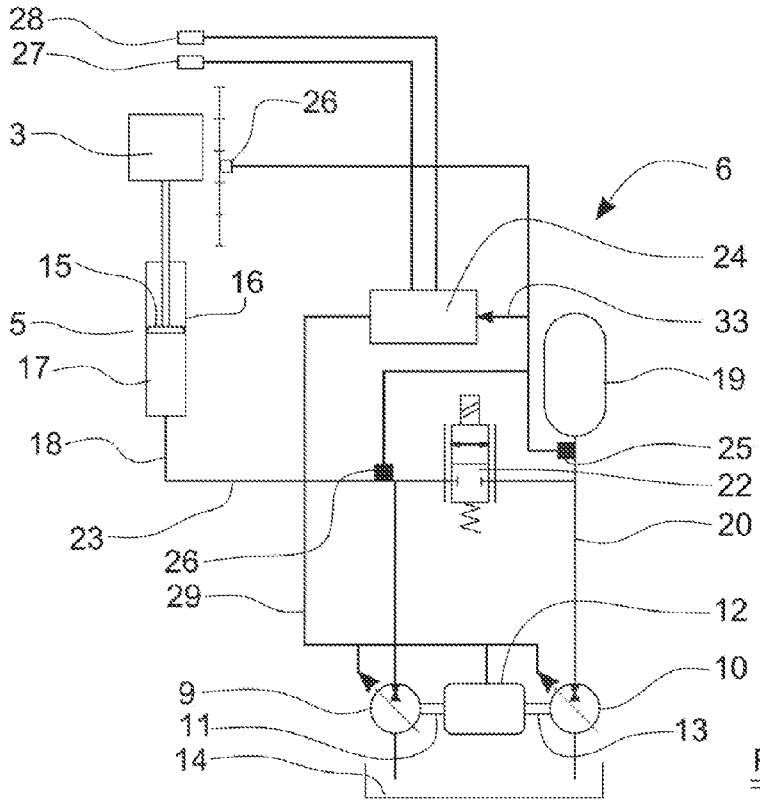
FIG. 2 is a schematic illustration of a heave compensating system shown employed in FIG. 1 which shows the principal hydraulic and control circuits of the system.

As illustrated most clearly in FIG. 2, the first hydraulic machine 9 has a drive shaft 11 which is directly connected to the axle of an electric motor 12 located between the two hydraulic machines 9, 10. Similarly, the second hydraulic machine has a drive shaft 13 which is directly connected to the opposite end of the motor's axle. The two hydraulic machines 9, 10 are thus mechanically connected to one another in a direct 1:1 ratio, via the motor 12, for co-rotation about a common axis. In alternative embodiments, the two hydraulic machines 9, 10 and the intermediate motor 12 are all mounted about a single, shared, drive shaft.

Both hydraulic machines 9, 10 are provided in fluid communication with a shared reservoir 14 for hydraulic fluid. The motor 12 may preferably be an asynchronous motor, although variable speed motors could be used in alternative embodiments.

The actuator 5, as is shown more clearly in FIG. 2, takes the form of a hydraulic ram comprising a slideably moveable piston 15 mounted within a cylinder 16. Movement of the piston 15 within the cylinder 16 is effective to lift or lower the load 3. The pressure side 17 of the actuator 5 is fluidly connected to the first hydraulic machine 9 via an actuator fluid line 18. As will be appreciated, movement of the first hydraulic machine 9 is thus effective to move the piston 15 of the actuator within the cylinder 16, and hence move the load 3 relative to the vessel. For example, operation of the first hydraulic machine 9 to pump hydraulic fluid via the actuator line 8 to the actuator 5 is effective to lift the load 3.

The second hydraulic 10 is fluidly connected to a hydraulic actuator 19 via an accumulator fluid line 20. The hydraulic accumulator 19 can take any convenient known form such as, for example; a piston type, a spring type, or a weight loaded type. For instance, an accumulator of the known bladder type may be used, in which the bladder 21 contains Nitrogen gas.

A valve 22 is provided in a bypass fluid line 23 extending between the actuator line 18 and the accumulator line 20. The valve 22 is operable to move from a first, closed, position as illustrated in FIG. 2 to a second, open, position effective to connect the accumulator 19 and the actuator 6 directly along the fluid line 23.

A controller 24 receives, via sensor cables 33, signals representative of; the position of the load 3 relative to the vessel from a position sensor 26; the accumulator pressure from pressure sensors 25, 26. The controller is also configured to receive signals representative of a wave-induced heave movement of the vessel and/or a wave induced force applied to the load, from sensors 27, 28. The controller preferably takes the form of a microcomputer, and is configured to control movement of the first and second hydraulic machines 9, 10, and to control the supply of motive power to the motor 12 via control cables 29, in response to said signals so as to maintain the position of, or load on, the load 3 substantially constant as the vessel moves in heave.

Figure 3:
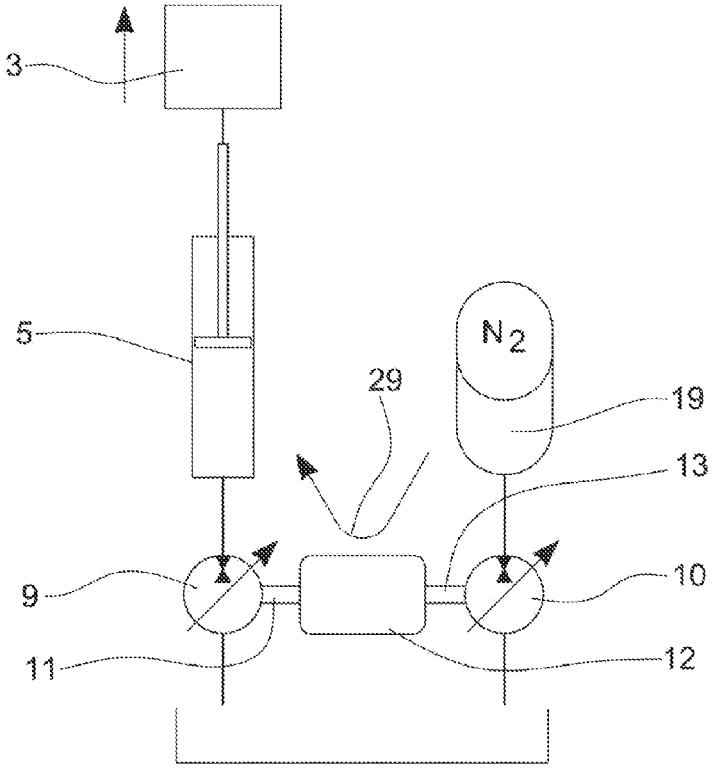
FIG. 3 is an illustration corresponding generally to that of FIG. 2, but which depicts the heave compensating system at an instant in which the load is being lifted in response the vessel falling in a wave trough.

Turning now to consider FIG. 3, a simplified illustration depicts the heave compensating system in an instant condition corresponding to downwards heave movement of the vessel, for example as the vessel falls in a wave trough. As the vessel 1 falls in this manner, then to maintain the load 3 in a substantially constant position relative to the seabed 7, the load must 5 be lifted, thereby reducing its distance below the vessel 1. The controller 24 operates to detect this heave movement of the vessel and responds by driving the first hydraulic machine 9 in the manner of a pump, to pump hydraulic fluid into the compensating actuator 5, thereby lifting the load 3 to compensate for the downwards motion of the vessel. The first machine is driven in this manner by the second machine 10, the second machine 10 operating in the 10 manner of a motor under the control of the controller 24, to provide torque to the coupled drive shafts 11, 13, and drawing energy for this drive from the accumulator 19. Arrow 29 thus denotes the flow of energy during this drive phase of the system.

Figure 4:
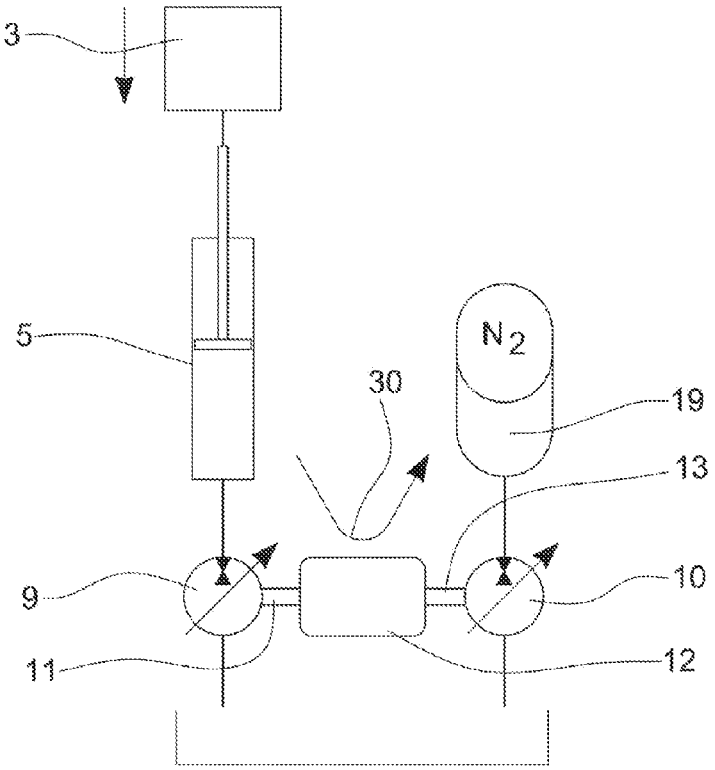
FIG. 4 is a similar illustration depicting the heave compensating system at an instant in which the load is being paid out from the vessel in response to the vessel rising on the crest of a wave.

FIG. 4 depicts the heave compensating system at an instant condition corresponding to upwards heave movement of the vessel 1, for example as the vessel rises on a wave crest. As the vessel 1 rises in this manner, then to maintain the load 3 in a substantially constant position relative to the seabed 7, the load must be lowered, thereby increasing its distance below the vessel. The controller operates to detect this upwards heave movement of the vessel and responds by actuating the first hydraulic machine 9 in the manner of a motor, driven by the hydraulic pressure applied by the compensating actuator 5. This movement of the first hydraulic machine 9 drives the coupled shafts 11, 13 and hence drives the second hydraulic machine 10 in the manner of a pump, increasing the pressure in the accumulator 19. Arrow 30 thus denotes the reversed flow of energy during this drive phase of the system.

Figure 5:
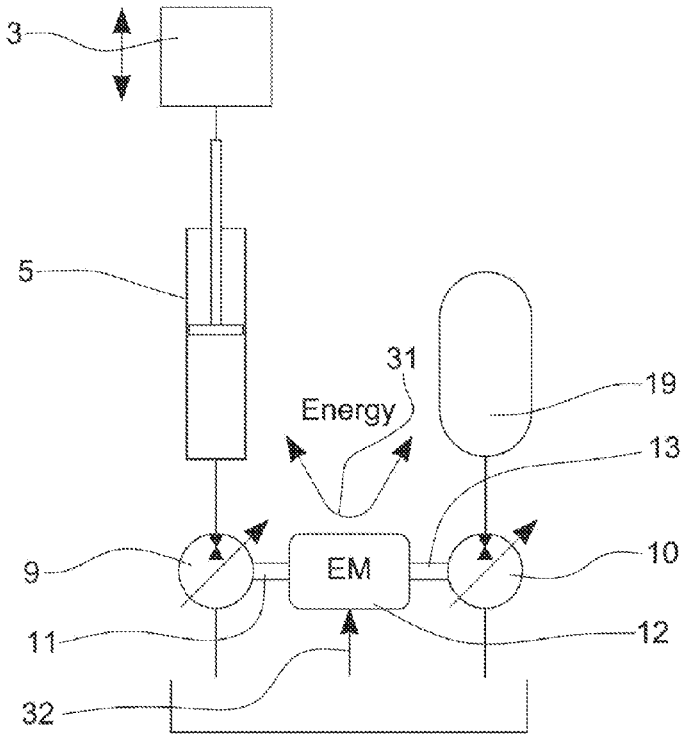
FIG. 5 depicts the heave compensating system in an active heave-compensating mode of operation.

As will be appreciated, the vessel's heave movement in a seaway will tend to alternate 5 continuously between upwards and downwards movement. The controller 24 thus operates to continuously adjust the position of the compensating actuator 5, alternating between the two drive phases explained above, as required to maintain the load in a substantially constant position relative to the seabed 7. This continuous operation is denoted in FIG. 5, where arrow 31 denotes the alternating flow of energy between the actuator 5 and the accumulator 19.

However, during operation in this manner, the energy content of the accumulator will gradually decrease over time due to losses caused by friction and damping in the mechanical structure and due to losses in the hydraulic machines 9, 10. The electric motor 12 is therefore operable, under the control of the controller 24, to compensate for these losses by adding torque to the shafts 11, 13 as required in order to maintain the mean value of energy in the accumulator 19 substantially constant. The controller 24 thus continuously monitors the signals from the sensor 25 which are indicative of the pressure within the accumulator over time, and selectively energizes the motor 12 (as depicted by arrow 32 in FIG. 5), during either a lifting or a lowering phase, to add energy back into the hydraulic system in the form of torque to the shafts 11, 13. The hydraulic machines 9, 10 then effectively convert this additional torque into hydraulic energy to balance the losses in the system arising from friction etc. In this mode of operation, the heave compensating system thus provides both a passive and an active function, but does so with a very simple and compact arrangement. In alternative embodiments of the disclosure, the controller 24 is configured to control the motor 12 at least partly in accordance with signals and data representative of previous cycles of vessel heave movement, or even in accordance with calculated data representative of predicted levels of energy recuperated from future heave cycles.

Figure 6:
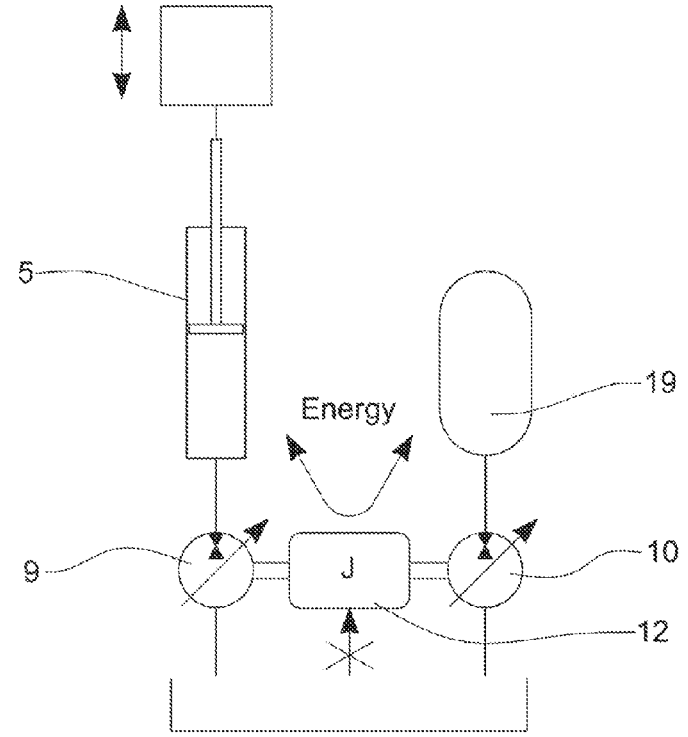
FIG. 6 depicts the heave compensating system in an alternative passive heave-compensating mode of operation.

While the heave compensating system 6 of the present disclosure has been described above with reference to a normal active/passive mode of operation, the system is sufficiently flexible to permit alternative modes of operation should conditions dictate that the normal mode is not possible. For example, FIG. 6 denotes the system in operation without the supply of energy to the electric motor 12, such as might be the case, for example, in the event of a power failure or outage onboard the vessel 1. In this situation, it is to be appreciated that the controller 24 and its associated circuitry will switch to be powered by an emergency generator or battery or the like, and so will remain operational. As will be appreciated, loss of electrical power to the motor 12 in these circumstances will preclude operation of the motor in the manner described above. In these circumstances, the heave compensating system will thus revert to a purely passive mode of operation as described above, with energy flowing to and fro between the actuator 5 and the accumulator 19 without any contribution of additional torque from the motor 12. However, it will be appreciated that rotation of the shafts 11, 13 during movement of the two hydraulic machines 9, 10 in this mode will still cause the motor 12 to rotate. The inertia of the inoperative motor in this mode of operation acts to stabilize the rotational speed of the shafts 11, 13. The system will continue to operate in this passive mode for a significant but nevertheless limited period of time, but will of course result in a gradual reduction in the mean pressure of the accumulator 19 due to losses in the system no longer being compensated by the motor 12. The controller 24 will continue to monitor the pressure of the accumulator, via the pressure sensor 25 during operation in this passive mode.

Figure 7:
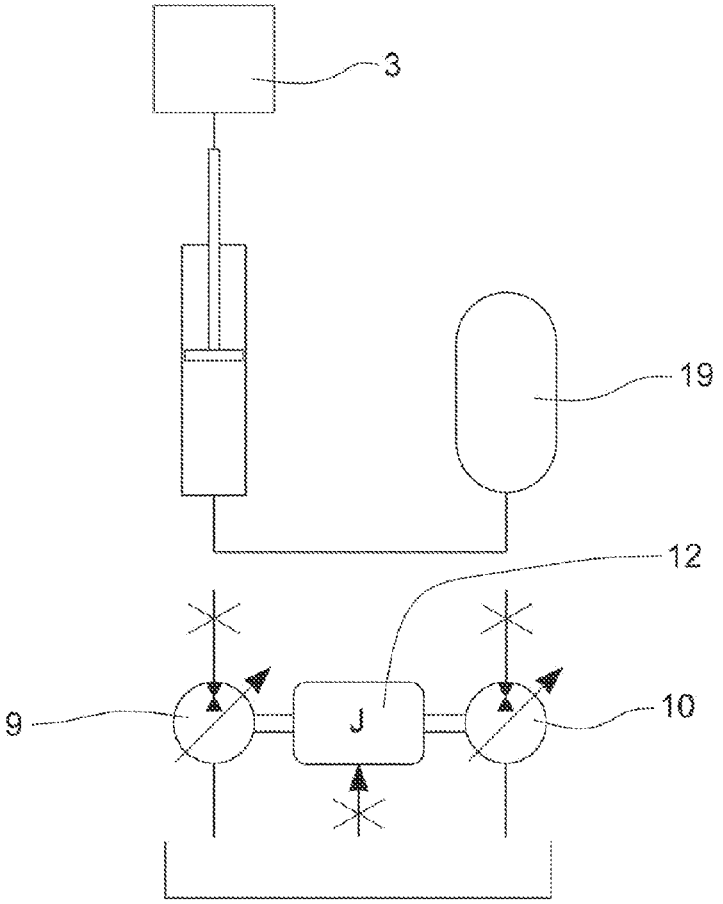
FIG. 7 depicts the heave compensating system in an alternative back-up mode of operation.

In the event that power is not timely restored to the electric motor 12 to permit reversion to the normal passive/active mode of operation, the pressure within the accumulator 19 will fall to a level at which the system cannot continue to operate satisfactorily. The controller 24 is thus configured to switch the system to a back-up mode of operation in such circumstances upon detection of the pressure in the accumulator 19 falling below a predetermined threshold limit as stored in an internal memory in the controller. In this situation, the controller operates to switch the valve 22 from its closed position illustrated in FIG. 2 to an open position effective to open the bypass flow line 23 between the accumulator 19 and the actuator 5, thereby directly connecting the accumulator to the actuator 5 and bypassing the hydraulic machines 9, 10 as depicted in FIG. 7. This helps to prevent the further loss of energy from the accumulator as a result of losses in the machines, and so a limited heave compensating function can be retained, albeit with larger force variations than would be the case in either the normal passive/active mode or the passive mode described above.

It is to be appreciated that the equipment of the embodiment described above, and in particular the hydraulic equipment represented by the actuator 5, the two hydraulic machines 9, 10, the accumulator 19 and the motor 12 can be used as a hydraulic power unit for general lifting and lowering operations of the crane 2. For example, in order to lower the load (or a drilling or coring tool) 3 from the vessel into the sea, the controller 24 system can be operated, under the control of the controller 24, in a non-compensating lowering mode in which the first hydraulic machine is operated in the manner of a motor, driven by the hydraulic pressure applied by the compensating actuator 5 generally as depicted in FIG. 4. When the load or tool has been lowered to the desired operational depth, it can then be maintained in that position by switching the system to its passive/active heave-compensating mode. When the load 3 or tool is subsequently to be lifted to the surface, the system can be switched out of the compensating mode and into a lifting mode, whereby the first hydraulic machine 9 is driven in the manner of a pump by the second hydraulic machine to lift the load generally as depicted in FIG. 3. The heave compensating system 6 of the present disclosure can thus be conveniently combined with a hydraulic lifting arrangement aboard the vessel 1.

Whilst the disclosure has been described above in detail with reference to particular embodiments of the disclosure, it is to be appreciated that various modifications or alterations may be made to the system without departing from the scope of the present disclosure. For example, although the embodiments described above are configured such that the two hydraulic machines and the electric motor are coupled in a direct 1:1 ratio, other embodiments are configured with a different ratio. In still other embodiments, the machines and the motor are coupled via a variable ratio gear arrangement.

When used in this specification and claims, the terms "comprises" and "comprising" and variations thereof mean that the specified features, steps or integers are included. The terms are not to be interpreted to exclude the presence of other features, steps or integers. The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

The invention claimed is:

1. A heave compensating system for a marine vessel, the system comprising:

a hydraulic actuator of the vessel configured to couple to a load suspended from the vessel and vary the distance between the load and the vessel in response to heaving motion of the vessel;

wherein the hydraulic actuator is connected to a first hydraulic machine for actuation by the first hydraulic machine;

a second hydraulic machine connected to a hydraulic accumulator, wherein both the first and second hydraulic machines are coupled to one another and to a shared electric motor;

a controller configured to control hydraulic movement of the first and second hydraulic machines and to control power to the electric motor in response to one or more signals representative of at least one of a wave-induced heave movement of the vessel and a wave induced force applied to the load;

wherein the first and second hydraulic machines and the electric motor are all mounted via a common drive shaft.

2. The system of claim 1, wherein the first and second hydraulic machines and the electric motor are coupled via a direct 1:1 ratio.

3. The system of claim 1, wherein the electric motor is disposed between the first hydraulic machine and the second hydraulic machine.

4. The system of claim 1, wherein the electric motor is an asynchronous motor.

5. The system of claim 1, further comprising a valve coupled to the accumulator and the actuator, wherein the valve is configured to move between a first position in which the accumulator and the actuator are fluidly isolated from one another, and a second position in which the accumulator and the actuator are connected.

6. The system according to claim 5, wherein the controller is configured to control operation of the valve in response to a signal representative of the hydraulic pressure in the accumulator, the controller being configured to move the valve from the first position to the second position in response to the pressure falling to a predetermined threshold value.

7. The system of claim 1, wherein the controller is configured to receive a signal representative of the hydraulic pressure in the accumulator, and to control power to the electric motor in response thereto.

8. The system of claim 1, wherein the controller is configured to receive a signal representative of the position of the load relative to the vessel and to control movement of the first and second hydraulic machines in response thereto.

9. The system of claim 1, wherein the controller is configured to maintain a substantially constant support force on the load suspended from the vessel during heaving movement of the vessel.

10. The system of claim 1, wherein the controller is configured to maintain the load suspended from the vessel in a substantially constant position during heaving movement of the vessel.

11. A method of operating a heave compensating system, comprising:

providing a first hydraulic machine, a second hydraulic machine, and an electric motor, wherein the first and second hydraulic machines and the electric motor are all mounted via a common drive shaft;

detecting a wave-induced heave movement of a vessel;

operating the first hydraulic machine in response to the detected wave-induced heave movement using a controller;

actuating a hydraulic actuator to vary the distance between the vessel and a load suspended from the vessel using the first hydraulic machine; and operating the second hydraulic machine using a controller to drive the first hydraulic machine.

12. The method according to claim 11, further comprising applying torque to a shaft coupled to the first and second hydraulic machines using an electric motor.

13. The method of claim 12, further comprising actively controlling energization of the electric motor using the controller.

14. The method of claim 11, further comprising connecting a hydraulic accumulator to the hydraulic actuator using a valve, in response to the pressure within the accumulator falling below a predetermined threshold value.

15. A heave compensating system for a marine vessel, the system comprising:

a hydraulic actuator of the vessel configured to couple to a load suspended from the vessel and vary the distance between the load and the vessel in response to heaving motion of the vessel;

wherein the hydraulic actuator is connected to a first hydraulic machine for actuation by the first hydraulic machine;

a second hydraulic machine connected to a hydraulic accumulator, wherein both the first and second hydraulic machines are coupled to one another;

a valve connected to the actuator and the accumulator, the valve configured to move between a first position in which the accumulator and the actuator are fluidly isolated from one another, and a second position in which the accumulator and the actuator are connected; and a controller configured to control hydraulic movement of the first and second hydraulic machines in response to one or more signals representative of at least one of a wave-induced heave movement of the vessel and a wave induced force applied to the load;

wherein the first and second hydraulic machines and an electric motor are all mounted via a common drive shaft.

16. The system of claim 15, wherein the electric motor is mechanically coupled to the first and second hydraulic machines, and wherein the electric motor is configured to provide a torque to the first and second hydraulic machines.

17. The system of claim 16, wherein the controller is configured to control power to the electric motor in response to one or more signals representative of at least one of a wave-induced heave movement of the vessel and a wave induced force applied to the load.

* * * * *